US010966506B2

(12) United States Patent
Dudik

(10) Patent No.: US 10,966,506 B2
(45) Date of Patent: Apr. 6, 2021

(54) DUAL-PISTON APPLIANCE FOR PROCESSING OF COSMETIC FORMULATIONS

(71) Applicant: REA Innovations, Inc., Seattle, WA (US)

(72) Inventor: Tristan Dudik, Vancouver, WA (US)

(73) Assignee: REA Innovations, Inc., Seattle, WA (US)

( * ) Notice: Subject to any disclaimer, the term of this patent is extended or adjusted under 35 U.S.C. 154(b) by 289 days.

(21) Appl. No.: 16/174,827

(22) Filed: Oct. 30, 2018

(65) Prior Publication Data

US 2020/0128941 A1 Apr. 30, 2020

(51) Int. Cl.

| | |
|---|---|
| ***A45D 44/00*** | (2006.01) |
| ***B01F 15/02*** | (2006.01) |
| ***B01F 15/06*** | (2006.01) |

(52) U.S. Cl.

CPC ..... *A45D 44/00* (2013.01); *B01F 15/0237* (2013.01); *B01F 15/06* (2013.01); *B01F 2015/061* (2013.01); *B01F 2015/062* (2013.01); *B01F 2215/0031* (2013.01)

(58) Field of Classification Search

CPC ..... A45D 44/00; A45D 2200/058; B01F 15/0237; B01F 15/06; B01F 2015/061; B01F 2015/062; B01F 2215/0031; B65D 81/3255

See application file for complete search history.

(56) References Cited

U.S. PATENT DOCUMENTS

| | | | | |
|---|---|---|---|---|
| 5,672,359 | A | 9/1997 | Digenis et al. | |
| 5,744,146 | A | 4/1998 | Peters et al. | |
| 6,391,288 | B1 | 5/2002 | Miyazawa et al. | |
| 6,655,551 | B2 * | 12/2003 | Manne | B01F 15/0237 222/132 |
| 7,066,640 | B2 | 6/2006 | Sands | |
| 7,311,195 | B2 * | 12/2007 | Schmid | B01F 13/002 206/219 |
| 7,622,132 | B2 | 11/2009 | Lee et al. | |
| 7,967,499 | B2 | 6/2011 | Tague et al. | |
| 9,717,319 | B2 | 8/2017 | Ebeling | |

(Continued)

FOREIGN PATENT DOCUMENTS

| | | | |
|---|---|---|---|
| CN | 106693785 | A | 5/2017 |
| CN | 107855026 | A | 3/2018 |

(Continued)

OTHER PUBLICATIONS

English-language machine translation of Chinese Patent Application Publication No. CN 106693785 A, May 24, 2017.

(Continued)

*Primary Examiner* — Charles Cooley

(74) *Attorney, Agent, or Firm* — Dascenzo Gates Intellectual Property Law, P.C.

(57) ABSTRACT

The appliance includes a housing and a stationary internal cup for receiving an unprocessed cosmetics portion. Inner and annular pistons with seals between the two pistons and between the annular piston and the stationary cup are moved sequentially up and down to mix the cosmetic portion to a processed skin formulation, the skin formulation being presented to the user when mixing is complete and the lid removed.

15 Claims, 11 Drawing Sheets

(56) References Cited

U.S. PATENT DOCUMENTS

| | | | | |
|---|---|---|---|---|
| 10,076,175 | B2 | 9/2018 | Wee | |
| 10,595,615 | B2 * | 3/2020 | Nichol | B05C 17/00566 |
| 2002/0048553 | A1 | 4/2002 | Baumgartner | |
| 2006/0147390 | A1 | 7/2006 | Schreiber et al. | |
| 2007/0172565 | A1 | 7/2007 | Kaiser et al. | |
| 2009/0181254 | A1 | 7/2009 | White et al. | |
| 2011/0052680 | A1 | 3/2011 | Hendrickson et al. | |
| 2011/0223224 | A1 | 9/2011 | Mathonnet et al. | |
| 2014/0106032 | A1 | 4/2014 | Dardelle et al. | |
| 2016/0270511 | A1 | 9/2016 | Wee | |
| 2016/0367449 | A1 | 12/2016 | Son et al. | |
| 2017/0042774 | A1 | 2/2017 | Shimizu et al. | |
| 2017/0049139 | A1 | 2/2017 | Tsutsumi et al. | |
| 2017/0304789 | A1 | 10/2017 | Tourel et al. | |
| 2019/0070078 | A1 | 3/2019 | Akridge | |
| 2019/0314774 | A1 | 10/2019 | Gros et al. | |
| 2020/0128941 | A1 * | 4/2020 | Dudik | A45D 44/00 |
| 2020/0405039 | A1 * | 12/2020 | Jung | |

FOREIGN PATENT DOCUMENTS

| | | | | |
|---|---|---|---|---|
| DE | 19735539 | B8 | 9/2010 | |
| EP | 0389700 | A1 | 10/1990 | |
| EP | 0594820 | B1 | 1/2000 | |
| EP | 0757529 | B1 | 6/2000 | |
| EP | 2265159 | B1 | 10/2011 | |
| EP | 2315543 | B1 | 11/2012 | |
| EP | 2543293 | A1 | 1/2013 | |
| EP | 3076837 | B1 | 2/2019 | |
| JP | 5472785 | B2 | 4/2014 | |
| KR | 96-009639 | B1 | 7/1996 | |
| KR | 10-2013-0079244 | A | 7/2013 | |
| KR | 10-1309511 | B1 | 9/2013 | |
| KR | 10-2014-0011550 | A | 1/2014 | |
| KR | 10-2008935 | B1 | 8/2019 | |
| WO | WO 2008/143372 | A1 | 11/2008 | |
| WO | WO 2011/000418 | A1 | 1/2011 | |
| WO | WO 2014/080093 | A1 | 5/2014 | |
| WO | WO 2016/087470 | A2 | 6/2016 | |
| WO | WO 2017/118800 | A1 | 7/2017 | |
| WO | WO 2018/042137 | A1 | 3/2018 | |
| WO | WO 2018/046344 | A1 | 3/2018 | |
| WO | WO 2018/073541 | A1 | 4/2018 | |
| WO | WO 2018/135551 | A1 | 7/2018 | |
| WO | WO-2019224313 | A1 * | 11/2019 | A45D 34/04 |

OTHER PUBLICATIONS

English-language machine translation of Chinese Patent Application Publication No. CN 107855026 A, Mar. 30, 2018.
English-language machine translation of German Patent No. DE 19735539 B8, Sep. 16, 2010.
English-language machine translation of European Patent Application Publication No. EP 0594820 B1, Jan. 19, 2000.
English-language machine translation of European Patent Application Publication No. EP 0757529 B1, Jun. 28, 2000.
English-language machine translation of European Patent No. EP 2315543 B1, Nov. 14, 2012.
English-language machine translation of Japanese Patent No. JP 5472785 B2, Apr. 16, 2014.
English-language machine translation of Korean Patent No. KR 96-009639 B1, Jul. 23, 1996.
English-language machine translation of Korean Patent No. KR 10-1309511 B1, Sep. 11, 2013.
English-language machine translation of Korean Patent No. KR 10-2008935 B1, Aug. 8, 2019.
English-language machine translation of Korean Patent Application Publication No. KR 10-2013-0079244 A, Jul. 10, 2013.
English-language machine translation of Korean Patent Application Publication No. KR 10-2014-0011550 A, Jan. 29, 2014.
English-language machine translation of PCT Patent Application Publication No. WO 2014/080093 A1, May 30, 2014.
English-language machine translation of PCT Patent Application Publication No. WO 2017/118800 A1, Jul. 13, 2017.
English-language machine translation of PCT Patent Application Publication No. WO 2018/042137 A1, Mar. 8, 2018.
English-language machine translation of PCT Patent Application Publication No. WO 2018/046344 A1, Mar. 15, 2018.
English-language machine translation of PCT Patent Application Publication No. WO 2018/073541 A1, Apr. 26, 2018.
English-language machine translation of PCT Patent Application Publication No. WO 2018/135551 A1, Jul. 26, 2018.
Orb product page.: www.spapliance.com/shop/theorb/whiteorb, available at least as early as Dec. 6, 2014.
EdensSecret1, "How to Decorate Bath Bombs," www.youtube.com/watch?v=E2rrgI2wbWs, published Jun. 15, 2016.
Dana Dey, "DIY Face Sheet Mask Machine for All Skin Types / All Natural—Kingdom Cares Mask Machine", www.youtube.com/watch?v=7emi4YaVJ6Y, published Aug. 12, 2017.
Admix, In-Tank and Inline Mixers, Powder Induction Systems and More: www.admix.com/equipment, available at least as early as Oct. 27, 2011.
My Make Up Brush Set DIY Facial Sheet Mask Maker product page: www.mymakeupbrushset.com/products/super-natural-facial-machine-maker, available at least as early as Jul. 5, 2018.
Tatcha Facial Cleansing Brush Set product product page: www.tatcha.com/product/FACE-BRUSH-SET.html, available at least as early as Mar. 26, 2018.
Vitamix Professional Series 750 blender product page: www.vitamix.com/us/en_us/Shop/Professional-Series-750, available at least as early as Jan. 31, 2015.
BlendJet One product page: blendjet.com/products/blendjet-one, available at least as early as Jul. 31, 2018.

* cited by examiner

DUAL-PISTON APPLIANCE FOR PROCESSING OF COSMETIC FORMULATIONS

TECHNICAL FIELD

This invention relates generally to cosmetic appliances, and more particularly to such appliances which mix an unprocessed cosmetic formulation and present the processed formulation for use.

BACKGROUND OF THE INVENTION

Cosmetics used for facial application are generally presented in ready-to-use jars. Such cosmetics include a wide variety of formulations to treat various skin conditions and skin sensitivities. This is also true for hair formulations. Such formulations, in particular skin formulations, with multiple ingredients, are usually premixed by the manufacturer and presented for sale by various retail outlets, including cosmetic counters at large department stores and at smaller specialty stores. Typically, the cosmetic jars/formulations include a wide variety of formulations from a large number of different manufacturers, providing the consumer a large number of choices for individual cosmetic needs/desires. However, such jars of premixed formulations are not freshly prepared such as when purchased and often have a long shelf time at cosmetic counters or in other retail outlets prior to actual sale and use by a customer. This can lead to deterioration of the product, particularly after opening the jar since the jars are typically multi-use size. Further, there is typically no convenient way to heat or cool the formulation so that it has a pleasant sensation, warm or cool, to the touch and to the skin when applied.

SUMMARY OF THE INVENTION

Accordingly, the appliance for processing cosmetic formulations, comprises: a housing; an internal cup for receiving a cosmetic portion; an inner piston member having an upper surface; an annular piston which surrounds the inner piston having a sealing relationship with the inner piston and the internal cup, the annular piston having an upper surface; an appliance lid with a lower portion positioned so that the upper surfaces of the respective pistons come adjacent thereto in operation when the lid is in place; and a motor assembly moving the inner piston and the annular piston up and down in a sequence that results in the pistons alternately coming adjacent the lower portion of the internal lid, such that the cosmetic portion is moved back and forth between the upper surfaces of the inner and annular pistons to accomplish mixing of the cosmetic portion, wherein the lid assembly is removable so as to present a processed cosmetic formulation for use.

BEST MODE FOR CARRYING OUT THE INVENTION

Figure 1:
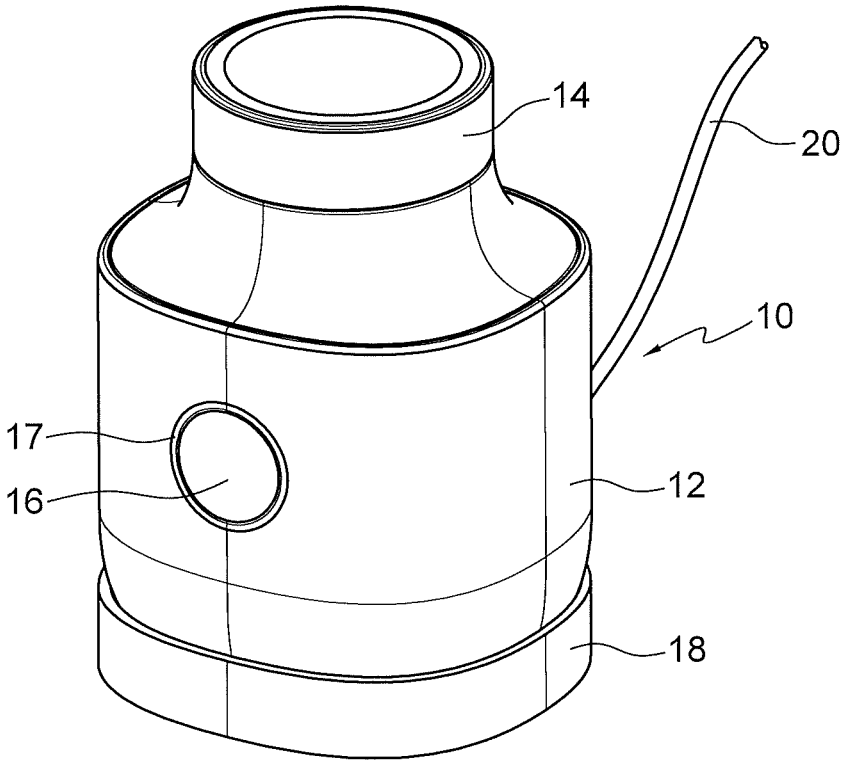
FIG. 1 is a schematic view of the appliance of the present invention.
Figure 2A:
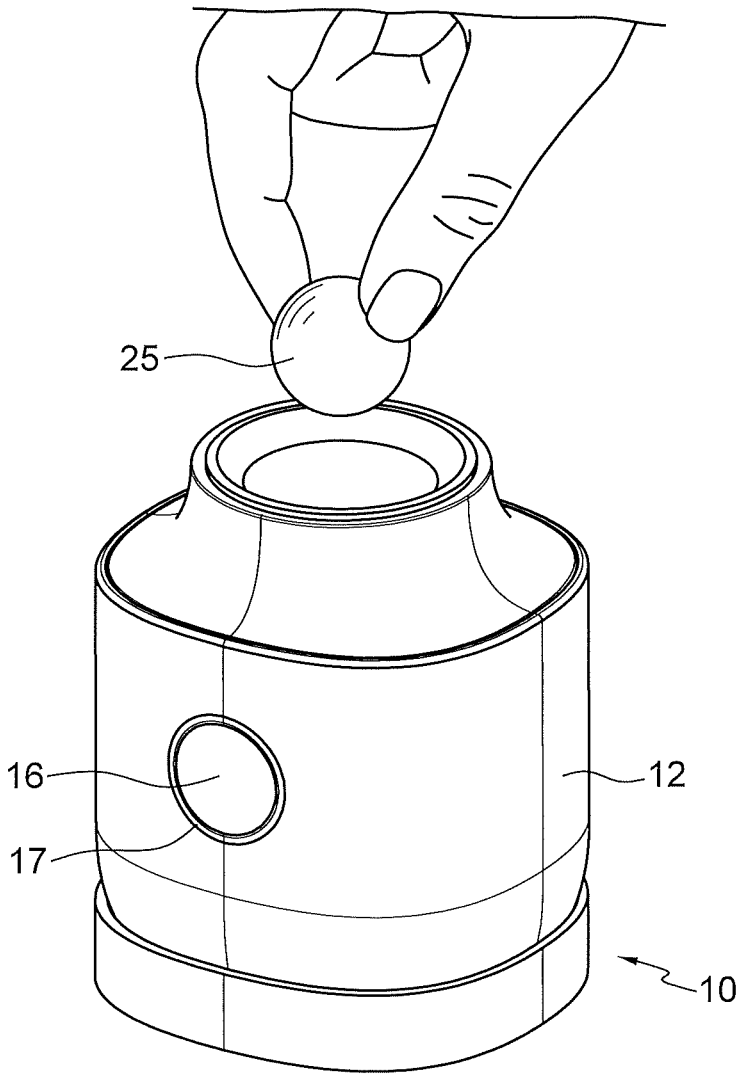
FIG. 2A shows a user loading a cosmetic portion into the appliance of FIG. 1.
Figure 2B:
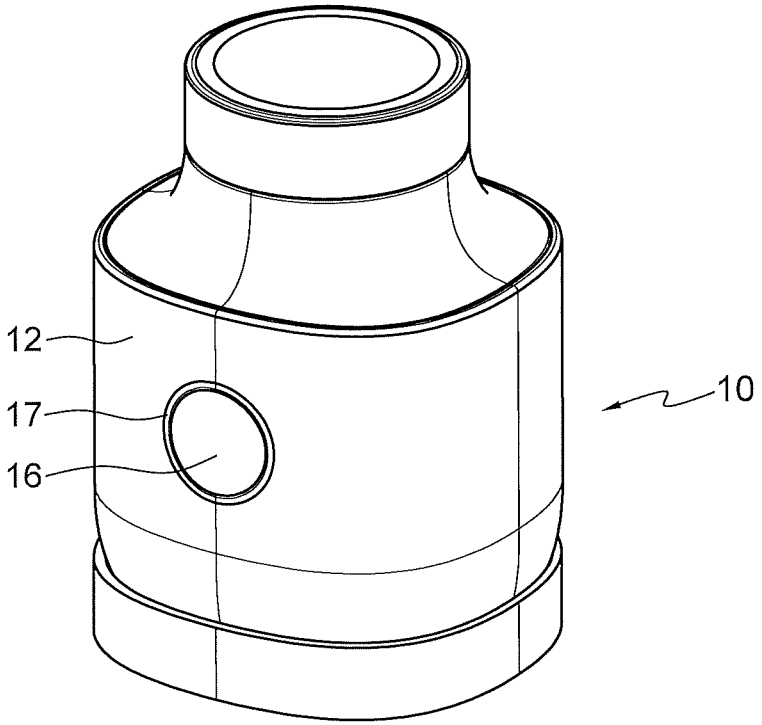
FIG. 2B shows the appliance of FIG. 1 during a mixing step.
Figure 2C:
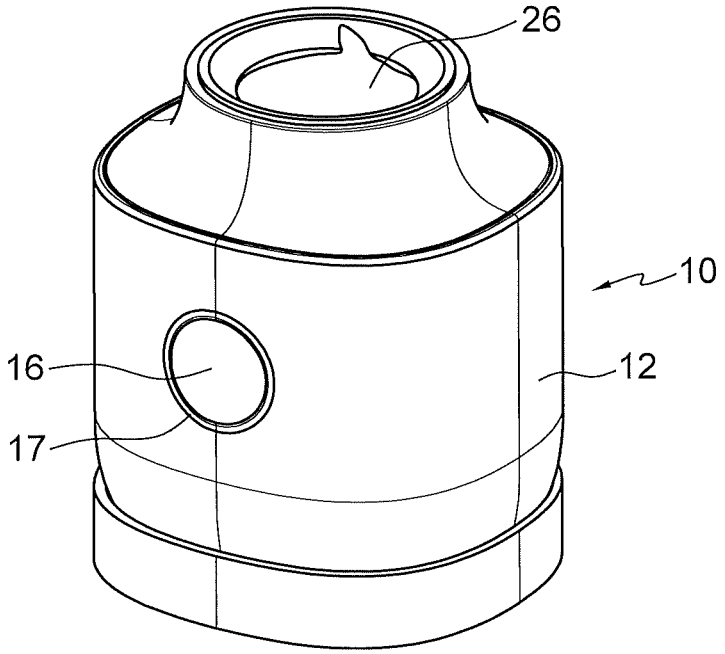
FIG. 2C shows a processed formulation presenting step in use of the appliance of FIG. 1.
Figure 4:
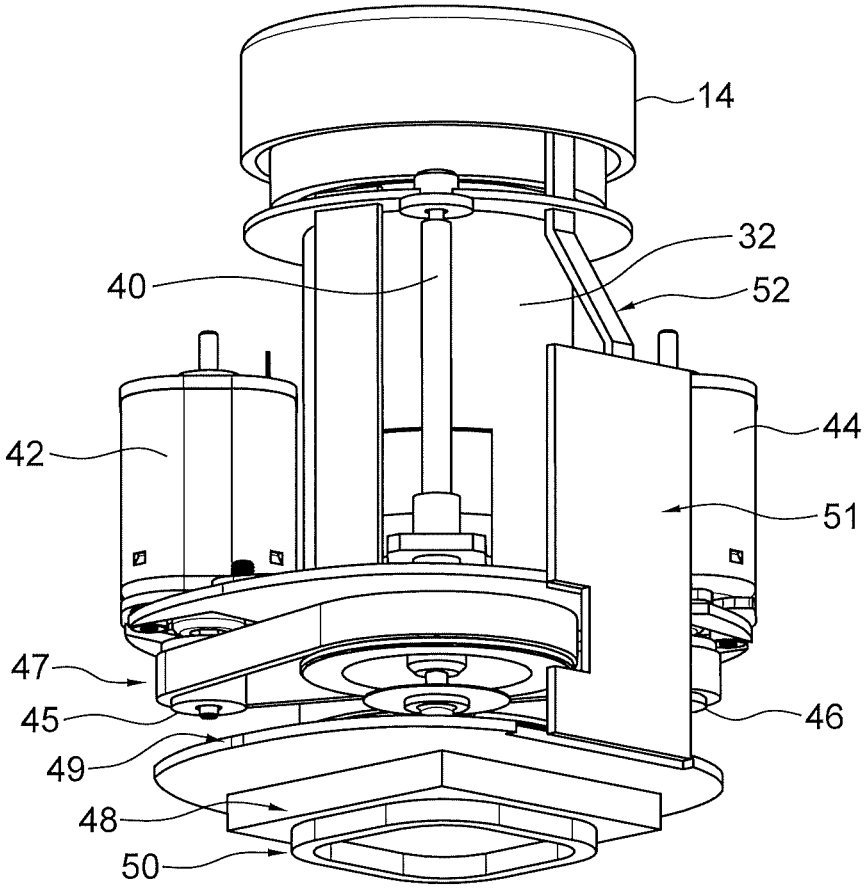
FIG. 4 is a schematic view of the motor drive system of the appliance of FIG. 1.
Figure 5:
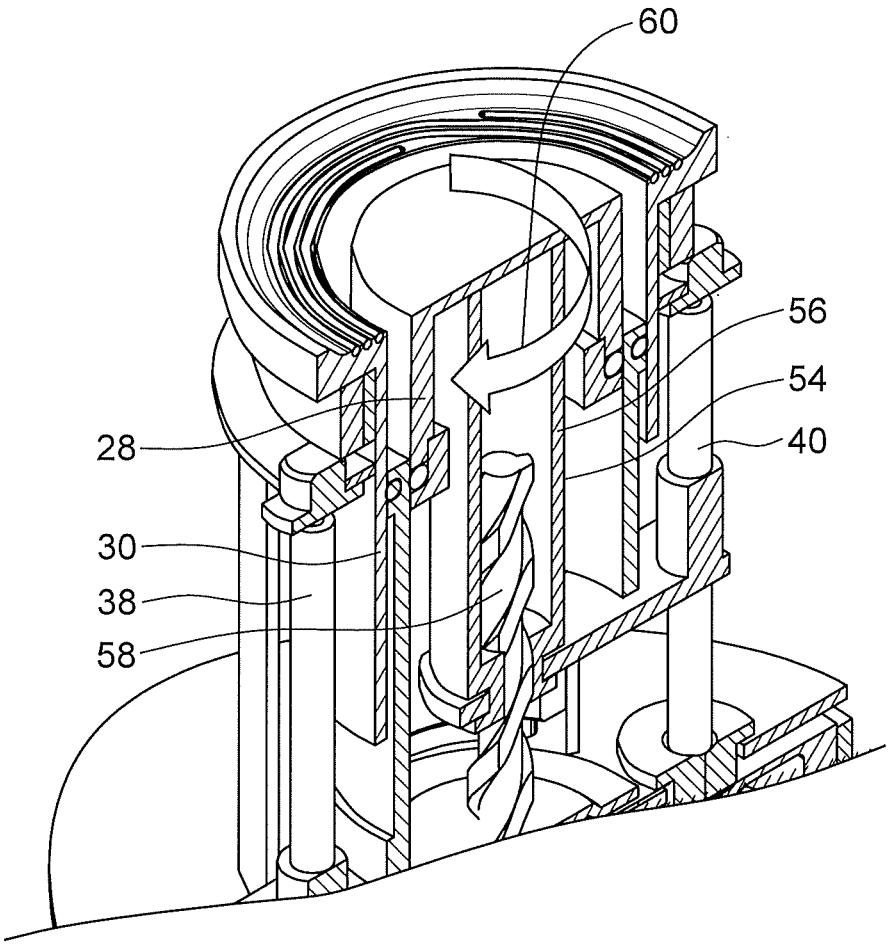
FIG. 5 is a cross sectional diagram showing a mechanism for providing a rotational aspect of cosmetics mixing.

FIG. 1 is an exterior view of the cosmetic appliance 10 of the present invention. The appliance includes a container 12, a lid 14 and a control button 16 with a display ring light 17 indicating the various operating phases of the appliance. The container 12 also may be referred to as a housing and is configured and arranged to fit on a charging base 18, with the charging base connected to wall power via a power cord 20. Referring now to FIGS. 2A-2C, in use the appliance 10 is typically on standby without display light 17 illuminated. The use of light to indicate operational status is by way of example only. Other indicators of operating status can be used. The microprocessor PCB 49 for control of the battery charging and discharging is shown in FIG. 4.

PCB 51 controls the indicator light and is responsive to control button 16. In a first step, the lid 14 is removed and a cosmetic portion 25 is inserted into the container by a user, as illustrated in FIG. 2A. The cosmetic portion is typically single use but can be multiple uses as well. The cosmetic portion 25 shown is spherical but can be other shapes, including oblong, disk, etc. The cosmetic portion can have a wide variety of ingredients, designed to treat particular skin conditions and skin sensitivities. Also, the cosmetic portion can be designed to treat various hair conditions. The term cosmetic herein thus refers to both skin and hair formulations. When lid 14 is removed, the battery for ring light 17 turns on; when the lid is replaced after the cosmetic portion is inserted, ring light 17 around the control button appears, i.e. illuminates. When control button 16 is then pressed, the cosmetic portion is mixed by the appliance, with the ring light 17 spinning, indicating that the appliance is operating. When the formulation is ready, i.e. mixed, which is indicated by ring light 17 pulsing, lid 14 can be removed, with the processed skin formulation shown at 26 being presented for use, as shown in FIG. 2C. The processed skin formulation is completely mixed and is warm to the touch if the appliance includes a heating element or cool to the touch if a cooling element is included. Both heating and cooling elements could be included.

Figure 3A:
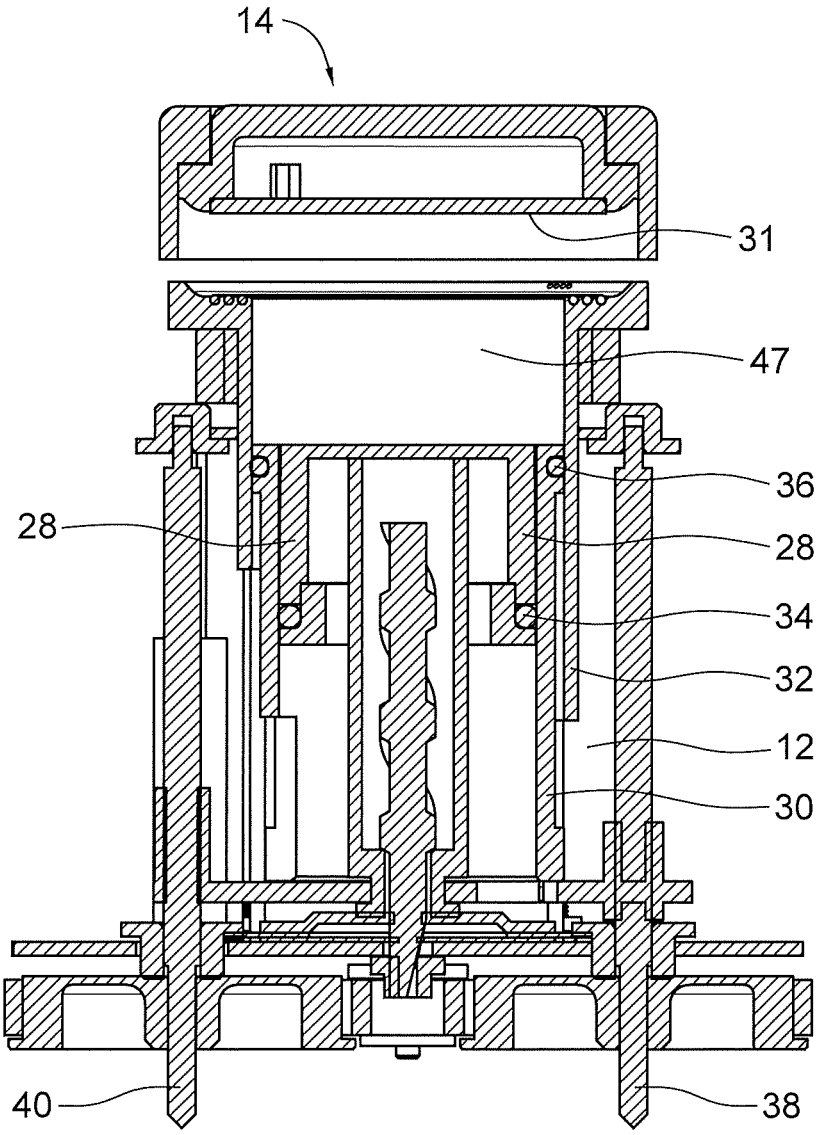
FIG. 3A is a cross-sectional diagram of the appliance of FIG. 1 showing a first step in the cosmetic mixing sequence of appliance operation.
Figure 3B:
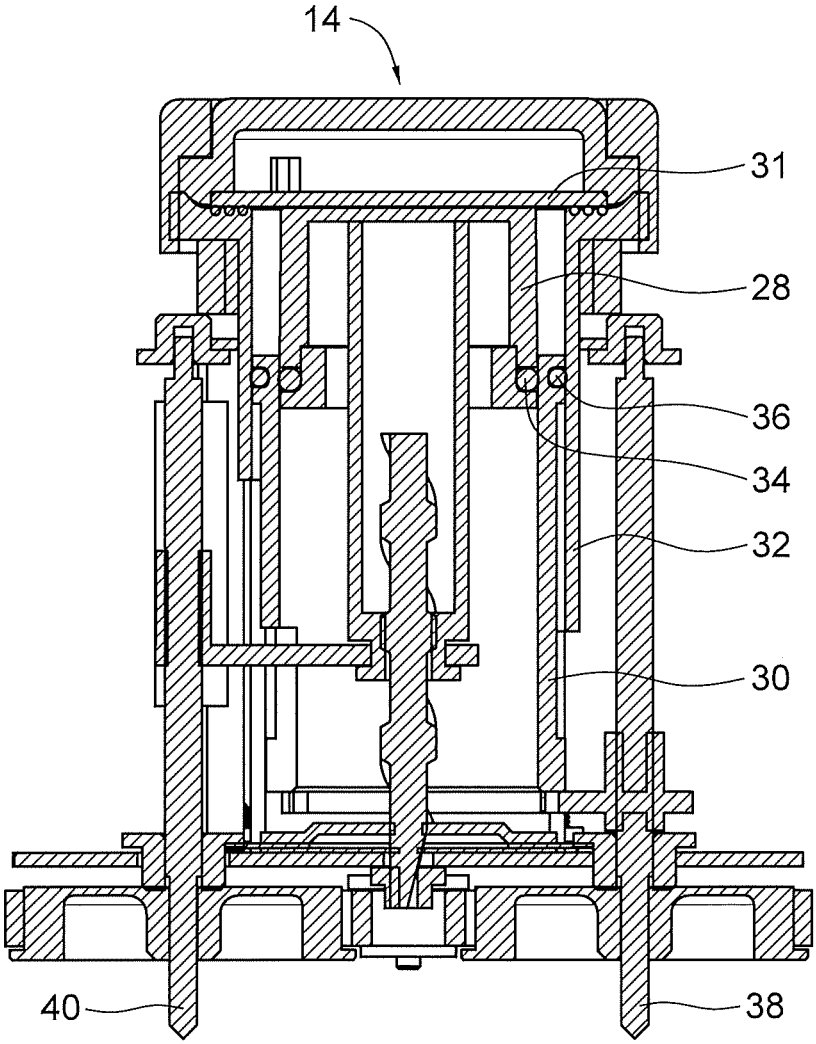
FIG. 3B is a cross-sectional diagram of the appliance of FIG. 1 showing a second step in the cosmetic mixing sequence of appliance operation.
Figure 3C:
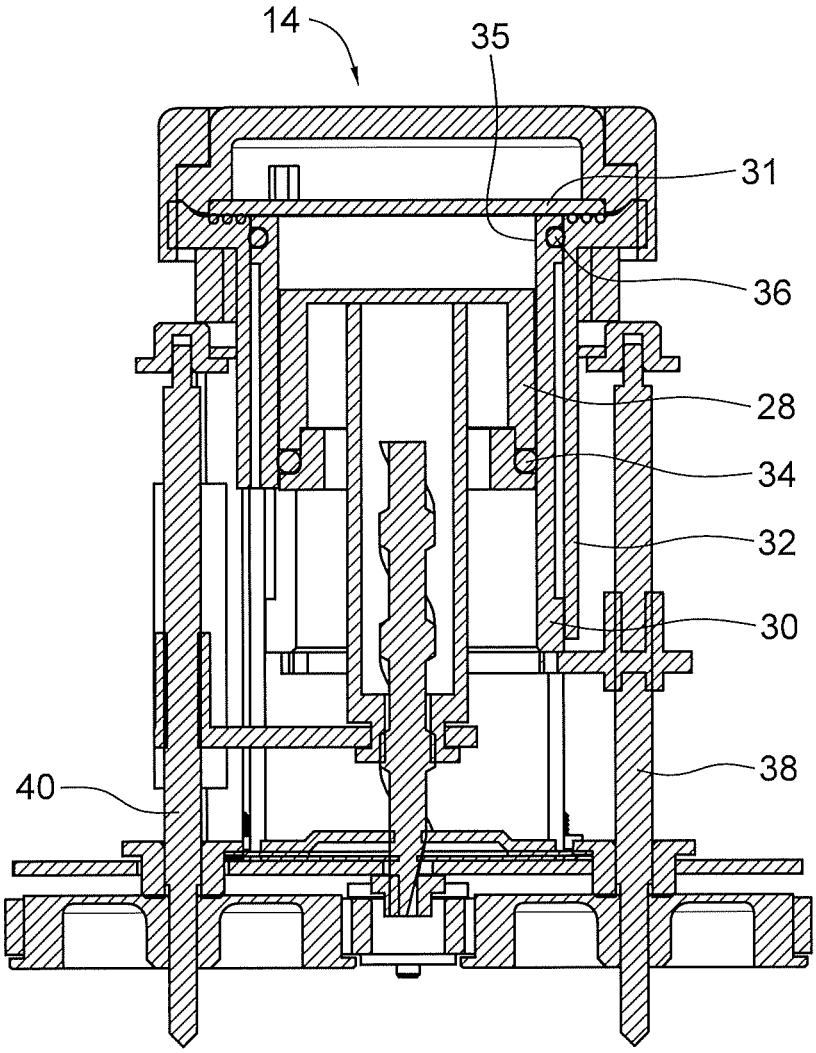
FIG. 3C is a cross-sectional diagram of the appliance of FIG. 1 showing a third step in the cosmetic mixing sequence of appliance operation.

FIGS. 3A-3C are cross sectional diagrams showing the mixing and heating structure of the appliance. The appliance includes an inner piston 28 and an annular piston 30 which surrounds the inner piston 28. Lid 14 has a lower portion 31. The annular piston fits inside a stationary inner cup 32 which is positioned within container 12. An O-ring 34 is positioned between the inner piston and the annular piston to provide sealing therebetween, while O-ring 36 is positioned between the annular piston and the stationary cup to provide sealing therebetween. Other sealing elements could be used, including piston or rod seals. In the embodiment shown, the respective pistons are moved up and down by respective jack screws 38 and 40, as described in more detail below. The respective movement of the pistons 28 and 30 produce a reliable mixing of the cosmetic portion 25 inserted into the appliance to form a freshly processed formulation ready for use.

When the cosmetic portion 25 is loaded into the appliance, both inner piston 28 and annular piston 30 are in a lowered position as shown in FIG. 3A, adjacent a volume 47 between the upper surfaces of the two pistons, which are coplanar at this point, and the lower portion 31 of lid 14. Initially, there is an air purging step in operation of the appliance. Both pistons 28 and 30 are moved upwardly together, compressing an O-ring spiral labyrinth structure, pressing air out through the spiral path of the labyrinth, which is described in more detail below. The pistons are then moved back to the lowered coplanar position. The inner piston 28 is then moved under microprocessor 49 control (FIG. 4) upwardly to the point where the upper surface of the piston comes adjacent the lower portion 31 of lid 14, forcing the skin formulation into the volume defined between inner piston 28, annular piston 30, which has not moved, lid portion 31 and inner cup 32. This is shown in FIG. 3B.

In the embodiment shown, the ratio of the areas of the top surfaces of the two pistons is approximately 2.1:1. This ratio can be varied within a range of 0.7:1 and 3:1. Using a smaller area with a longer stroke for the annular piston helps mixing by generally forcing the material through smaller spaces.

The inner piston 28 is next moved downwardly to its original position, while the annular 30 piston moves upwardly as far as it can move, forcing the formulation into the volume defined between the upper surface of the inner piston, the lower portion 31 of the lid and the inner surface 35 of the annular piston. This is shown in FIG. 3C. The annular piston 30 is then moved downwardly back to its original position. The above sequence of piston movement repeats, until the cosmetic portion is completely mixed. Complete mixing usually takes a number of cycles, although typically 100 cycles is sufficient to produce a well processed formulation ready for presenting to the user when the lid 14 is removed. A range of 75-200 cycles can be used, depending on the composition of the cosmetic being processed.

The drive mechanism for the appliance is shown in FIG. 4. The stationary cup 32 is shown as well as lid 14. In the embodiment shown, two motors 42 and 44 under microprocessor control 49 are used to move the two pistons as described above. The motors drive the associated jack screws 38 and 40 (only 40 is shown in FIG. 4) to produce the sequential up and down piston action. The drive shafts 45, 46 from motors 42 or 44 are connected via a belt and pulley arrangement 47 to drive the individual jack screws. As implemented, two servo-controlled, brushed DC motors drive the belts, which turn drive the multi-start jack screws 38 and 40. The belt drive could be replaced with other types of belt or chain, geared reduction or direct drive. The jack screws could be replaced with any rotary-to-linear mechanical device including belts or a rack and pinion set. The motors could be driven with any of several control arrangements including servo control. A range of motors could be used, including brushed DC motors, brushless DC motors and stepper motors. Also, magnetically driven sonic motors can be used. The piston motion can alternatively be driven with a mechanical logic system and a single motor.

FIG. 4 also shows the position of battery 48 for the appliance which drives the motors, as well as a charge coil 50 in the appliance which mates with charging base 18 for charging. PCB microprocessors 49 (motor control) and 51 (light control) are also shown. FIG. 4 also shows a sensor 52 to indicate the presence of the lid. It should be understood that while the embodiment shown includes 2 motors, one for each piston, a single motor can be used with a different belt and pulley arrangement to control the two separate jack screws.

Referring now to FIG. 5 and FIGS. 3A-3C, the appliance in one embodiment includes a spiral follower 54 which is positioned inside the inner piston 28. The spiral follower 54 has a spiral groove 56 on its surface to which a high-helix screw 58 connects. In the embodiment shown, screw 58 is prevented from rotating when piston 28 is moving downward and allowed to rotate when the piston moves upward, with the result that the piston achieves rotation in one direction only. In operation, the inner piston turns as it moves downward on the helix, achieving additional mixing of material, as shown by the arrow 60. Although this arrangement is not necessary, it does improve the mixing of the cosmetic.

Figure 6A:
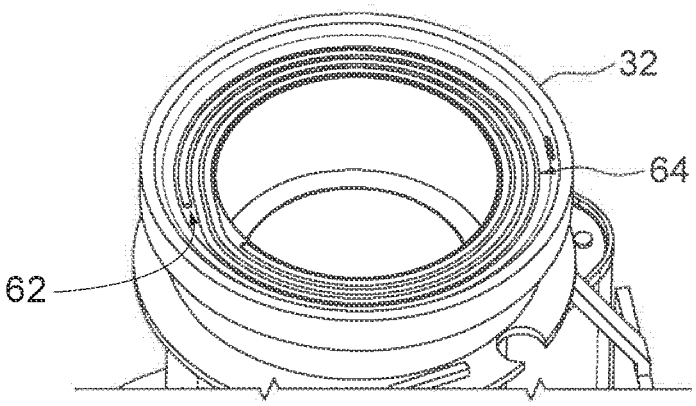
FIG. 6A is a schematic diagram showing an air venting system for the appliance of FIG. 1.
Figure 6B:
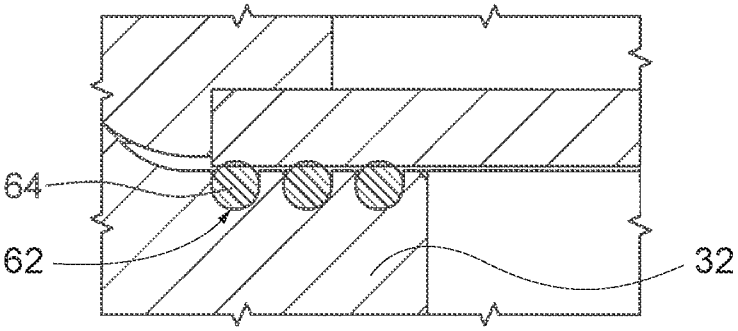
FIG. 6B is a partial cross-sectional diagram of the air venting system of FIG. 6A.
Figure 6C:
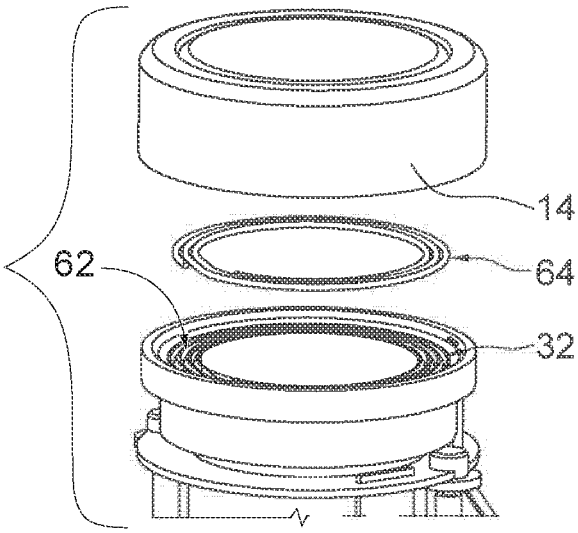
FIG. 6C is a partial exploded view of the air venting system of FIG. 6A.

FIGS. 6A and 6B show what is referred to as an O-ring spiral labyrinth structure. When the cosmetic portion is initially flattened by action of the inner piston, as discussed above, at atmospheric pressure, air needs to be vented. In order to vent air without releasing any of the cosmetic being mixed, a small cross section O-ring labyrinth arrangement is included. FIG. 6A shows the stationary cup 32. On the top surface of cup 32 is a machined spiral groove 62, with two partial or incomplete O-ring lines 64 positioned in the spiral groove 62. The O-ring portions are cut and positioned in groove 62, so that there is a space between opposing ends of the O-rings. The ends of the O-ring lines extend from an opening in the cup. The space between the two O-rings allows venting of air from the appliance without releasing any cosmetic. FIG. 6C is partial exploded view showing the O-ring labyrinth arrangement of FIG. 6A with O-ring lines 64 illustrated spaced apart from groove 62.

Figure 7:
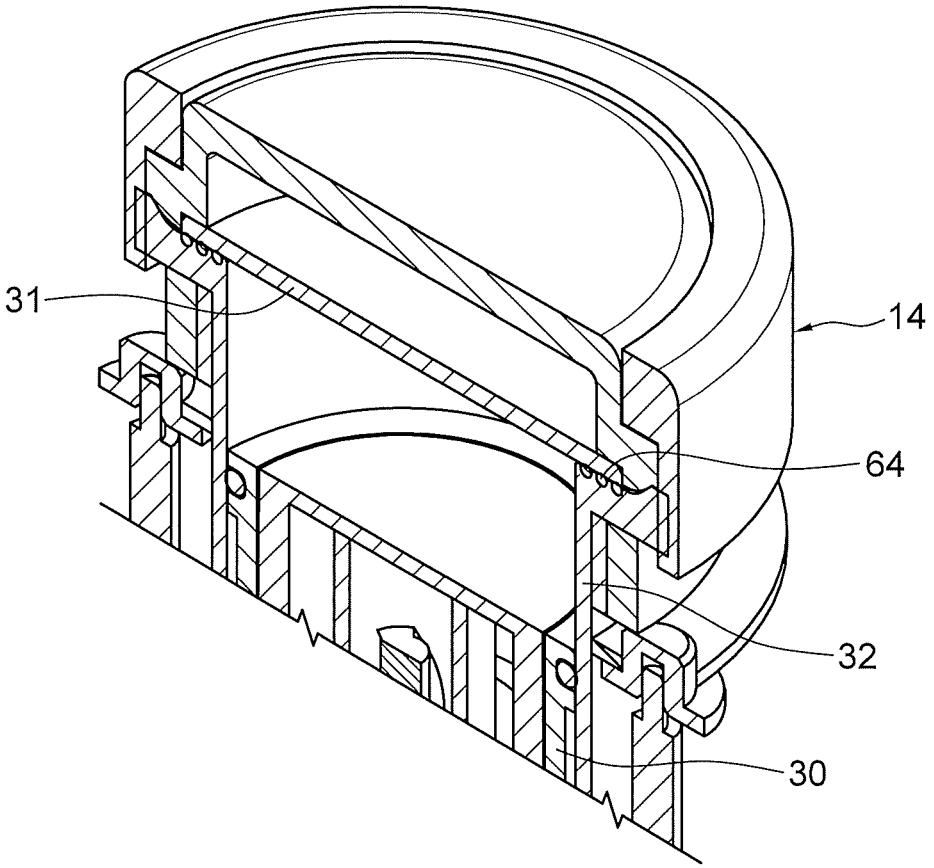
FIG. 7 is a cross sectional diagram showing a mechanism for heating the cosmetics during mixing.

The appliance also includes a heating element, shown in FIG. 7, which improves customer satisfaction and also helps to produce the final processed formulation. The lower rim 31 of lid 14 can be heated, as well as the top of the cup 32. Both of these when heated supply heat energy to the formulation as it is being mixed so that it is pleasantly warm when presented for use. The mixed formulation can also be cooled, if desired, by the use of thermoelectric modules in the lid or cup.

Figure 8A:
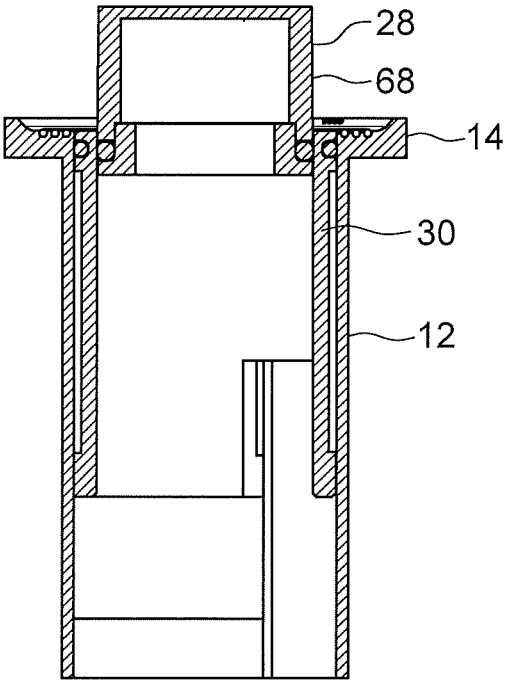
FIG. 8A is a cross sectional view of the appliance arranged for cleaning.
Figure 8B:
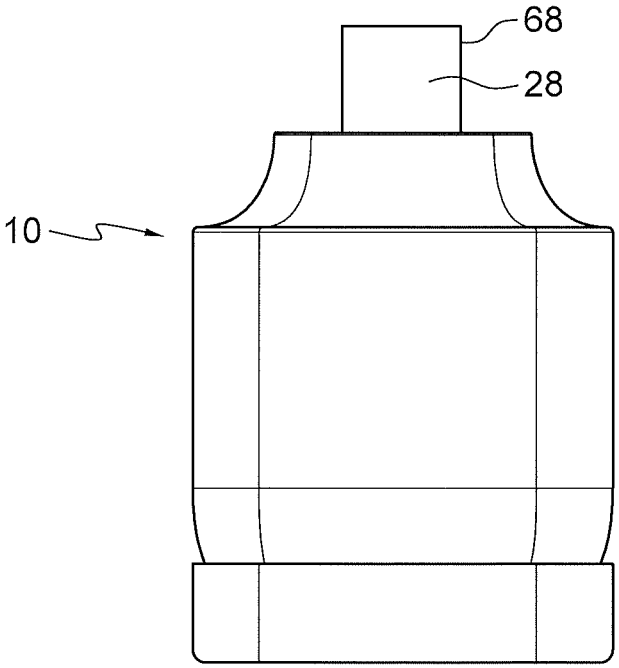
FIG. 8B is a schematic diagram of the appliance arranged for cleaning.

After a number of uses, or even one, outer surface 60 of inner piston 28 above O-ring 38 could become dirty. In the present embodiment, control button 16 can be pushed for a selected time, such as 3 seconds, which results by microprocessor programming in inner piston 28 rising to an extended position, as shown in FIGS. 8A and 8B, exposing piston surface 68. The ring light 17 can, in one embodiment, turn a selected color, such as blue, to indicate cleaning. The surface 68 can then be wiped clean. Control button 16 can then be held for another selected time, resulting in the inner piston returning to its normal steady state position shown in FIG. 3A.

Accordingly, an appliance has been described which uses two concentric pistons within a stationary cup with an alternating up and down motorized movement to mix a cosmetic portion and produce a processed formulation for use. The appliance can also include a heating element which can warm the processed formulation and/or a cooling element. The presented formulation is always freshly made and able to provide its desired function for the user.

Although the appliance has been described for skin formulations, it should be understood that hair formulations can also be used.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. An appliance for processing cosmetic formulations, comprising:

a container;

an internal cup for receiving a cosmetic portion and positioned within the container;

an inner piston having an upper surface;

an annular piston which surrounds the inner piston having a sealing relationship with the inner piston and the internal cup, the annular piston having an upper surface;

a lid with a lower portion positioned so that the upper surface of the inner piston and the upper surface of the annular piston come adjacent thereto in operation when the lid is in place; and a motor assembly moving the inner piston and the annular piston up and down in a sequence that results in the annular piston and the inner piston alternately coming adjacent the lower portion of the lid, such that the cosmetic portion is moved back and forth between the upper surface of the inner piston and the upper surface of the annular piston to accomplish mixing of the cosmetic portion, wherein the lid is removable so as to present a processed cosmetic formulation for use.

2. The appliance of claim 1, wherein the motor assembly includes separate motors for moving the inner piston and the annular piston independently of one another.

3. The appliance of claim 1, including O-ring seals between the inner piston and the annular piston and between the annular piston and the internal cup.

4. The appliance of claim 1, herein the internal cup is stationary.

5. The appliance claim 1, wherein the inner piston and the annular piston are in a lowered position at the start of the sequence, wherein in a first mixing step, the annular piston is driven initially upwardly and forces the cosmetic portion into a volume between the inner piston and the lower portion of the lid, wherein the first mixing step is followed by a second mixing step, in which the annular piston is lowered and the inner piston is raised to force the cosmetic portion onto the upper surface of the annular piston, wherein the second mixing step is followed by a third mixing step, in which the inner piston is lowered, and wherein the first mixing step, the second mixing step, and the third mixing step are repeated sequentially in the sequence until mixing of the cosmetic portion is completed.

6. The appliance claim 1, including a spiral grooved helix member positioned internally of the inner piston and a screw element cooperating with the spiral grooved helix member to provide a rotation of the cosmetic portion as the inner piston moves in a selected direction.

7. The appliance claim of 1, wherein a ratio of an area of the upper surface of the inner piston to an area of the upper surface of the annular piston is in the range of 0.7:1 to 3:1.

8. The appliance claim of 7, wherein the ratio is approximately 2:1.

9. The appliance of claim 1, wherein an upper portion of the appliance includes a heater element to warm the cosmetic portion during mixing thereof.

10. The appliance of claim 1, Wherein an upper portion of the appliance includes a cooling element to cool the cosmetic portion during mixing thereof.

11. The appliance of claim 1, wherein the inner piston is controllable for movement to an extended position when the lid is off, exposing an outer surface of the inner piston forcleaning.

12. The appliance of claim 1, further including a spiral groove in the upper surface of the internal cup and O-ring sections positioned therein for venting of air to outside of the appliance.

13. The appliance of claim 12, wherein the venting of air occurs prior to initial mixing of the cosmetic portion.

14. The appliance of claim 1, wherein the processed cosmetic formulation is a skin formulation.

15. The appliance of claim 1, wherein the processed cosmetic formulation is a hair formulation.

* * * * *